US009169799B2

(12) United States Patent
Seeger

(10) Patent No.: US 9,169,799 B2
(45) Date of Patent: Oct. 27, 2015

(54) ENGINE CYLINDER HEAD PROVIDED WITH LIGHT VALVE SPRING BOSSES

(71) Applicant: GM GLOBAL TECHNOLOGY OPERATIONS LLC, Detroit, MI (US)

(72) Inventor: Peter Seeger, Bensheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/196,910

(22) Filed: Mar. 4, 2014

(65) Prior Publication Data

US 2014/0245986 A1 Sep. 4, 2014

(30) Foreign Application Priority Data

Mar. 4, 2013 (GB) ..... 1303837.7

(51) Int. Cl.
*F02F 1/42* (2006.01)
*F01L 1/46* (2006.01)
*F01L 3/10* (2006.01)

(52) U.S. Cl.
CPC . *F02F 1/42* (2013.01); *F01L 1/462* (2013.01); *F01L 3/10* (2013.01)

(58) Field of Classification Search
CPC ..... F02F 1/42; F01L 1/462; F01L 3/10
USPC ..... 123/193.5, 90.65, 90.67
See application file for complete search history.

(56) References Cited

U.S. PATENT DOCUMENTS

| | | | | | |
|---|---|---|---|---|---|
| 3,633,556 | A * | 1/1972 | Inoue | 123/90.22 |
| 4,509,473 | A * | 4/1985 | Hamparian | 123/188.17 |
| 5,121,718 | A * | 6/1992 | Saito | 123/90.27 |
| 6,532,925 | B1 * | 3/2003 | Moya | 123/90.65 |
| 6,811,143 | B2 * | 11/2004 | Creissel et al. | 251/337 |
| 7,299,782 | B2 * | 11/2007 | Netsu et al. | 123/196 M |
| 2007/0017474 | A1 | 1/2007 | Muhr et al. | |
| 2009/0151661 | A1 | 6/2009 | Ahn | |
| 2010/0001224 | A1 | 1/2010 | Edgar | |

FOREIGN PATENT DOCUMENTS

| | | | | |
|---|---|---|---|---|
| DE | 4224495 | A1 | 1/1994 | |
| DE | 4421408 | A1 | 12/1995 | |
| DE | 19601981 | A1 | 7/1997 | |
| EP | 0408080 | A2 | 1/1991 | |
| EP | 1515007 | A1 | 3/2005 | |
| GB | 1417310 | A | 12/1975 | |
| JP | 59155518 | A * | 9/1984 | F01L 3/08 |

* cited by examiner

*Primary Examiner* — Lindsay Low
*Assistant Examiner* — Grant Moubry
(74) *Attorney, Agent, or Firm* — Ingrassia Fisher & Lorenz PC

(57) ABSTRACT

A cylinder head for an internal combustion engine is provided which include a valve spring boss having a central opening for accommodating a valve and having a contact area for retaining said valve. The contact area has a first portion and a second portion. The first portion being ring-shaped and delimited by the opening, and the second portion being radially protruding from the first portion.

8 Claims, 2 Drawing Sheets

ENGINE CYLINDER HEAD PROVIDED WITH LIGHT VALVE SPRING BOSSES

CROSS REFERENCE TO RELATED APPLICATION

This application claims priority to British Patent Application No. 1303837.7 filed Mar. 4, 2013, which is incorporated herein by reference in its entirety.

TECHNICAL FIELD

The present disclosure relates to a cylinder head for an internal combustion engine and is aimed to define a new solution for its valve spring bosses, allowing a weight reduction of the boss itself and the cylinder head casting as a whole.

BACKGROUND

It is known that internal combustion engines are provided with a cylinder head, which sits above the cylinders on top of the cylinder block. It closes in the top of the cylinder, forming the combustion chamber. Cylinder head are often realized in aluminum or other light metal alloys. In most engines, the cylinder head also provides space for the passages that feed air and fuel to the cylinder, and that allow the exhaust to escape. The cylinder head is also a place to mount the valves, spark plugs, and fuel injectors.

In particular, to mount valves and related valve springs, ensuring the closing of the valves, cylinder heads are also provided with bosses. According to a known design, bosses are part of the cylinder head casting and have a circular shape. The boss includes a central opening to allow the assembly of the valve. The boss also comprises an annular seat, around the central opening, for the assembly of a valve spring and a valve sealing element. Said valve spring is a compression spring, whose elastic force guarantees the closing of the valve, when the latter is not pushed by the cam of the camshaft in its opening phase. The valve spring transmits its elastic force, through the valve sealing element, to the boss seat, which accommodates the valve sealing element.

An investigation about the present cylinder head design, and in particular about the valve spring boss could be useful since engine manufacturers are generally struggling to obtain weight reductions wherever possible.

Therefore a need exists for a new design, defining a cylinder head lighter without any disadvantages for the function.

SUMMARY

An object of an embodiment of the present disclosure is to provide a new design of a cylinder head, wherein new valve spring bosses are designed to gain a remarkable volume and, consequently, mass reduction, compared to the known valve spring bosses. Another object of the present disclosure is to define different possible shapes of such bosses, all of them characterized by comparable mass reduction with respect to the standard ones. These objects are achieved by a cylinder head including such valve spring boss, having the features recited in the independent claim.

An embodiment of the disclosure provides a cylinder head for an internal combustion engine, the cylinder head having a valve spring boss, the valve spring boss having a central opening for accommodating a valve and having a contact area for retaining said valve, wherein the contact area has a first portion and a second portion, the first portion being ring-shaped and delimited by the opening and the second portion radially protruding from the first portion.

An advantage of this embodiment is that the contact area for retaining the valve is no more an annular seat inside the valve spring boss, but is the top surface of the boss. In this way, the overall extension of the contact area can be reduced with respect to the extension of the former annular seat, by acting on the dimensioning of both its ring-shaped first portion and its second portion, radially protruding from the first portion, just verifying that the whole boss contact area, supporting the valve sealing element and consequently the spring load, gets a pressure enough smaller than the aluminum compression strength.

According to an aspect of this embodiment, an outer contour of the valve spring boss is defined by a projection of the contact area in a direction perpendicular to the contact area. An advantage of this aspect is that this outer contour of the boss allows to reduce the whole volume and mass of the boss, with respect to a boss known design. As consequence of the reduced volume, the boss has a better cast ability and is easy to be machined (less material to cut away).

According to another embodiment, the cylinder head comprises a valve spring boss, whose outer contour is circular. A circular outer contour of the valve spring boss is a feasible way of carrying out the invention, bringing the further advantage that the boss can be casted by using similar tools as in the standard process.

According to a further embodiment, the second portion of the valve spring boss contact area the valve spring boss has exactly three or exactly four protrusions. A plurality of protrusions, preferably three or four protrusions, in the second portion of the boss contact area are further ways of carrying out the invention, being feasible a casting tool which can realize such shapes, for example, a casting tool whose inner contour is defined by a "spline" curve.

According to an aspect of this embodiment, the protrusions are equally spaced along the circumference of the first portion. An advantage of this embodiment is that it guarantees a symmetrical distribution of the load, which is transmitted by the valve spring to the boss contact area.

According to a still further embodiment, the ratio of the radial extension of the first portion to the radial extension of the second portion ranges between 1:2 and 1:1. An advantage of this embodiment is that a feasible range of the ratio of the radial extension of the first portion to the radial extension of the second portion can be defined. In fact, taking into account the further condition that the overall extension of the boss contact area has always to be smaller than the extension of the former annular seat, a ratio lower than 1:2 would result in an insufficient contact area to support the valve spring load. On the other side, a ratio 1:1 would result in a limit condition, according to which the second portion is not protruding from said first portion, that is to say the whole contact area would assume a circular outer contour. Keeping these dimensioning conditions, a remarkable lighter valve spring boss would be obtained, in some cases more than halved in weight, with respect to the known cylinder head bosses.

BRIEF DESCRIPTION OF THE DRAWINGS

The various embodiments will hereinafter be described in conjunction with the following drawing figures, wherein like numerals denote like elements, and wherein.

DETAILED DESCRIPTION OF THE DRAWINGS

The following detailed description is merely exemplary in nature and is not intended to limit the present disclosure or the application and uses of the present disclosure. Furthermore, there is no intention to be bound by any theory presented in the preceding background or the following detailed description.

The following considerations form the concepts behind the present disclosure. As mentioned, according to a known design, the valve spring boss includes an annular seat, around the central opening, for the assembly of the valve spring and the valve sealing element. The valve spring transmits its elastic force, through the valve sealing element, to the boss seat, which accommodates the valve sealing element.

Figure 2:
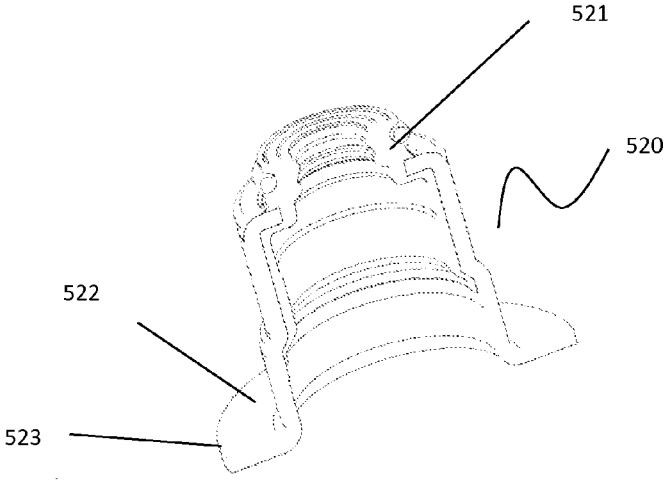
FIG. 2 represents a valve sealing element.
Figure 3:
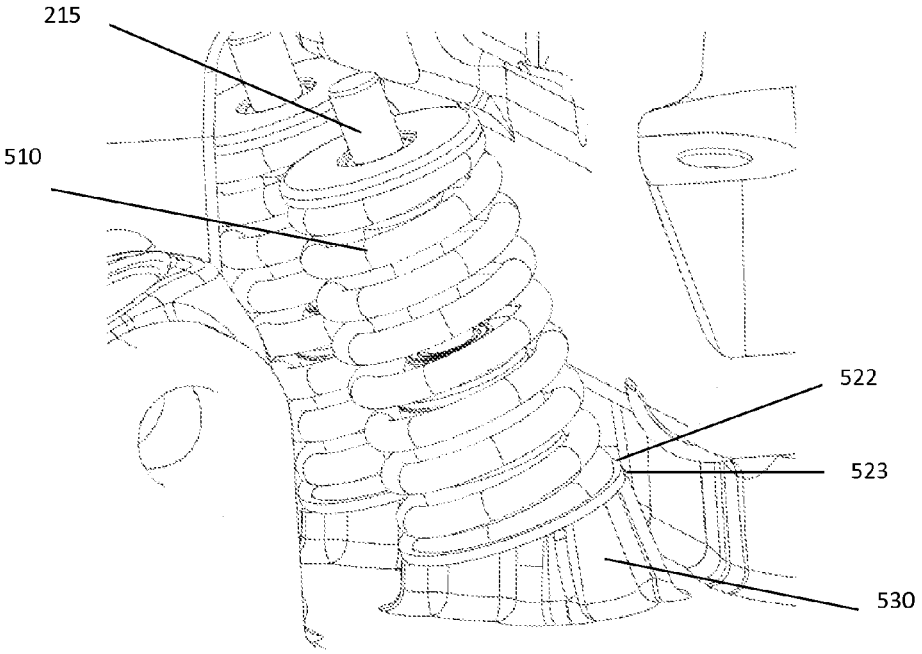
FIG. 3 depicts the assembly of the valve and the valve spring in the valve spring boss of FIG. 1.

Since the valves 215 selectively allow air, coming from the intake manifold, to enter into the combustion chamber from the intake port, and alternately allow exhaust gases to exit through the exhaust port toward the exhaust manifold, this element has the function to avoid that air or exhaust gases can wrongly flow through the cylinder head towards the area where the camshaft is located. As can be seen in FIG. 2, the valve sealing element 520 consists of two parts, a rubber one 521 which is responsible of the sealing, and a steel one 522, which supports the valve spring 510 and the related spring force.

The maximum spring force, which arises when the valve lift reaches its maximum, is not very high, with respect to the available boss surface under the valve sealing element. For a 4-valve, 4-cylinder engine, for example, the maximum spring force is about 400 N. Such consideration leads to the fact that it would be possible to reduce the boss contact area, retaining the valve.

Figure 1:
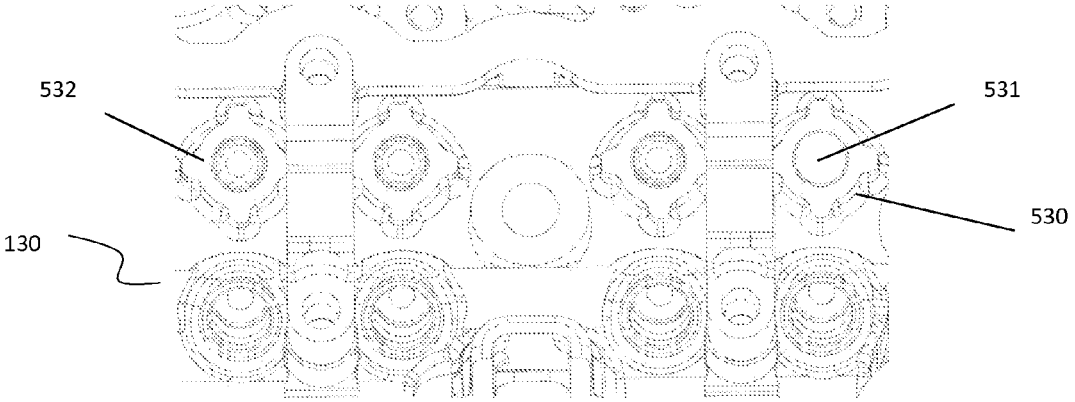
FIG. 1 shows a valve spring boss in a cylinder head according to the present invention.
Figure 4:
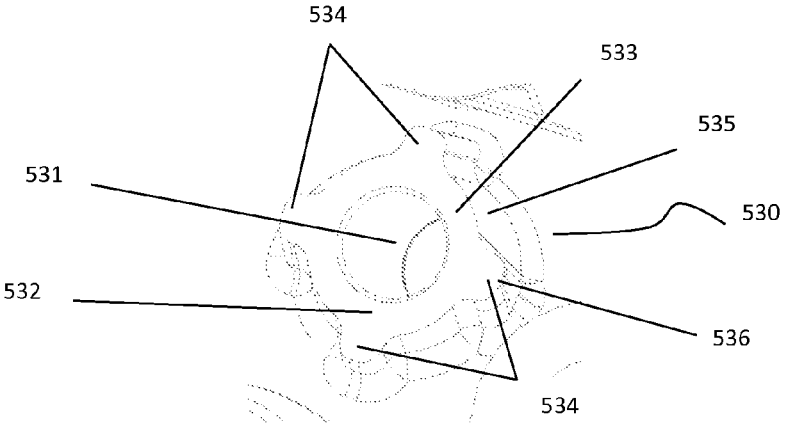
FIG. 4 shows the shape of the valve spring boss of FIG. 1 according to a preferred embodiment.

Therefore, as shown in FIGS. 1, 2 and 4, a preferred embodiment of the present disclosure provides a valve spring boss 530 in a cylinder head 130 having a central opening 531 for accommodating the valve 215 and a contact area 532 for retaining said valve. The contact area has a first portion 533 and a second portion 534. The first portion 533 is ring-shaped and delimited by the opening. The second portion 534 is radially protruding from the first portion 533. In other words, the contact area 532 for retaining the valve is no more an annular seat inside the valve spring boss, as in a standard design. The contact area is just the top surface of the boss. In this way, the overall extension of the contact area can be reduced with respect to the extension of the former annular seat, by acting on the dimensioning of both its ring-shaped first portion and its second portion, radially protruding from the first portion. Such dimensioning has to ensure that the diameter of a circumference, circumscribing the second portion 534 of the contact area 532, is smaller than the outer diameter of the annular seat of the known bosses.

Of course, this new dimensioning has to ensure that the whole boss contact area, supporting the valve sealing element and consequently the spring load, gets a pressure enough smaller than the aluminum compression strength. The new design of the valve spring boss 530 is absolutely suitable for this function. In fact, considering the example of a 4-valve, 4-cylinder engine, an available top surface of the new valve spring boss 530 is about 80 $mm^2$ Assuming a max. spring force of about 400 N, it yields a max. surface pressure of 5 $N/mm^2$, which is remarkably below the compression strength of the aluminum, by (at least one order of magnitude higher).

Advantageously, the outer contour 535 of the valve spring boss 530 is defined by a projection of the contact area 532 in a direction perpendicular to the contact area. So defining the outer contour 535 of the boss 530, it is possible to obtain reduced volume and mass of the boss, with respect to a known boss. In fact, in a known boss the outer contour is a projection of an external circumference, surrounding the annular seat, in a direction perpendicular to said annular seat. As mentioned, being the diameter of the circumference, circumscribing the second portion 534 of the contact area 532, smaller than the outer diameter of the known annular seat, the projection of the contact area 532 defines a smaller volume of the boss. As consequence of the reduced volume, the boss has a better cast ability and is easy to be machined (less material to cut away).

As non-limitative example, the outer contour 535 of the valve spring boss could be circular, that is to say, this new valve spring boss is round-shaped as the standard one, but always characterized by a smaller outer diameter. This embodiment is a feasible way of carrying out the invention, bringing the further advantage that the boss can be casted by using similar tools as in the standard process.

Another possible way of carrying out the invention consists in the fact the valve spring boss 530 is provided with exactly three or exactly four protrusions 536. This embodiment is easy to be realized as well; it being a casting tool which can realize such shapes, for example, a casting tool whose inner contour is defined by a "spline" curve.

Preferably, such protrusions 536 are equally spaced along the circumference of the first portion. This solution guarantees a symmetrical distribution of the load, which is transmitted by the valve spring to the boss contact area.

According to a further preferred embodiment, the ratio of the radial extension of the first portion 533 to the radial extension of the second portion 534 ranges between 1:2 and 1:1. This range has been defined taking into consideration the general guidelines in dimensioning this new cylinder head boss: the overall extension of the boss contact area has always to be smaller than the extension of the former annular seat; at the same time, the extension of the contact area has to be sufficient to support the valve spring load; the first portion of the contact area should always be delimited by the central opening of the boss, which is needed for accommodating the valve. By CAD simulation, a ratio lower than 1:2 would result in an insufficient contact area to support the valve spring load. On the other side, a ratio 1:1 would result in a limit condition, according to which the second portion is not protruding from said first portion, that is to say the whole contact area would assume a circular outer contour.

Keeping these dimensioning conditions, a remarkable lighter valve spring boss would be obtained. In fact, with some dimensioning according to this solution, it is possible to reach a mass reduction of the valve spring boss 530 with respect to a known valve spring boss 500 greater than 50%. Having a valve spring boss more than halved in weight and, considering the high number of bosses in the cylinder head, the solution remarkably reduces the overall weight of the cylinder head.

Therefore, a cylinder head adopting this new valve spring bosses will result much lighter than the known cylinder heads, without incurring in any functional penalties. The proposed example allows to gain 1% weight reduction of the whole cylinder head, which is also beneficial for the fuel consumption of the engine.

Moreover, due to the fact that the bosses are smaller, the cast ability of the whole cylinder head will be improved, the machining will be easier and the oil draining will be improved as well. Furthermore, all these advantages leads to a remarkable cost saving.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A cylinder head for an internal combustion engine comprising:

a valve spring boss having a central opening for accommodating a valve and having a contact area for retaining said valve;

wherein the contact area comprises:

a first ring-shaped portion delimited by the central opening; and a second portion, comprising a plurality of protrusions radially protruding from the first portion; and wherein the first ring-shaped portion and the second portion comprise coplanar portions of the contact area.

2. The cylinder head according to claim 1, wherein the valve spring boss comprises an outer contour defined by a projection of the contact area in a direction perpendicular to the contact area.

3. The cylinder head according to claim 2, wherein the outer contour of the valve spring boss is circular.

4. The cylinder head according to claim 1, wherein the second portion of the valve spring boss contact area comprises at least three protrusions.

5. The cylinder head according to claim 4, wherein the second portion of the valve spring boss contact area comprises three protrusions.

6. The cylinder head according to claim 4 wherein the second portion of the valve spring boss contact area comprises four protrusions.

7. The cylinder head according to claim 4, wherein the protrusions are equally spaced along the circumference of the first portion.

8. The cylinder head according to claim 1, wherein a ratio of a radial extension of the first portion to a radial extension of the second portion is between 1:2 and 1:1.

* * * * *